United States Patent [19]

Warnaka

[11] 4,339,018

[45] Jul. 13, 1982

[54] SOUND ABSORBING STRUCTURE

[75] Inventor: Glenn E. Warnaka, Erie, Pa.

[73] Assignee: Lord Corporation, Erie, Pa.

[21] Appl. No.: 170,408

[22] Filed: May 19, 1980

Related U.S. Application Data

[62] Division of Ser. No. 955,543, Oct. 27, 1978, Pat. No. 4,243,117, which is a division of Ser. No. 692,834, Jun. 4, 1976, Pat. No. 4,141,433.

[51] Int. Cl.[3] ..... E04B 1/99; G10K 11/04

[52] U.S. Cl. ..... 181/286; 181/224; 181/288; 181/292

[58] Field of Search ..... 181/284, 286, 288, 292–295, 181/285, 210, 218, 224, 248, 290, 291

[56] References Cited

U.S. PATENT DOCUMENTS

| | | | |
|---|---|---|---|
| Re. 22,283 | 3/1943 | Bourine | 181/248 |
| 2,887,173 | 5/1959 | Boschi | 181/286 |
| 3,113,634 | 12/1963 | Watters | 181/224 |
| 3,180,448 | 4/1965 | Gary, Jr. et al. | 181/290 |
| 3,269,484 | 8/1966 | Lighter | 181/290 |
| 3,353,626 | 11/1967 | Cremer et al. | 181/224 |
| 3,433,322 | 3/1969 | Olsson | 181/285 |
| 3,734,234 | 5/1973 | Wirk | 181/286 |
| 3,831,710 | 8/1974 | Wirk | 181/286 |
| 3,913,702 | 10/1975 | Wirk et al. | 181/286 |
| 3,991,848 | 11/1976 | Davis | 181/286 |
| 4,069,768 | 1/1978 | Matsumoto et al. | 181/210 |
| 4,141,433 | 2/1979 | Warnaka | 181/286 |

FOREIGN PATENT DOCUMENTS

| | | |
|---|---|---|
| 916732 | 8/1954 | Fed. Rep. of Germany . |
| 1064968 | 12/1953 | France . |
| 733329 | 7/1955 | United Kingdom . |
| 761132 | 11/1956 | United Kingdom . |

*Primary Examiner*—Richard A. Wintercorn
*Assistant Examiner*—Benjamin R. Fuller
*Attorney, Agent, or Firm*—Thomas L. Kautz

[57] ABSTRACT

A plurality of parallel and laterally spaced impermeable walls define an array of side-by-side elongate fluid filled cavities. Adjacent open ends of the cavities provide a sound-receiving or admittance end for the sound waves into the cavities. An acoustically reflective, preferably impermeable, barrier is disposed adjacent the ends of the cavities remote from their sound-receiving end and terminates the cavities. The cavities are uniquely configured to provide an effective geometrical sound absorbing structure while minimizing the structural elements required and, thus, the cost of manufacture.

5 Claims, 10 Drawing Figures

SOUND ABSORBING STRUCTURE

BACKGROUND OF THE INVENTION

Sound absorbing devices of many types have heretofore been proposed. Such prior art devices have relied upon sound absorbing characteristics of materials employed in the device, the geometrical arrangement of a plurality of structural elements, which structural elements alone have no particular advantageous sound absorbing properties, and combinations or hybrids of sound absorbing materials and geometrical arrangements of structural elements.

Sound absorbing materials do not function efficiently at low acoustical frequencies, do not normally have structural strength by themselves sufficient for use in many applications, are readily contaminated in many environmental conditions and are difficult to clean. Geometrical sound absorbing structures or devices, on the other hand, as a normal matter, do not suffer from the disadvantages of sound absorbing materials. However, geometrical sound absorbing structures previously proposed have been relatively complicated and expensive in comparison to cost of sound absorbing materials for comparable sound absorbing performance. This factor is primarily attributed to the required structure and the frequent intervals at which structural elements of features must be reproduced and the resultant cost of materials, machinery, processes, and labor in forming such structures.

Perhaps the oldest known geometrical sound absorbing device is the resonant cavity which is accessible by sound waves through restricted openings, suitably sized and arranged. Such structures typically comprise a network of elongate cellular structures accessible at one end by sound waves through an admittance area of prescribed impedance. The other ends of the cellular structures are terminated by some type of acoustically reflective barrier. By proper control of the admittance of sound waves and geometry of the cellular structures, air or other fluid within the cells can be caused to resonate and, thus, dissipate the energy of the sound waves, largely through viscous losses. Such resonators have very high sound absorbing capacity in a limited frequency band. A plurality of such resonators may be tuned for different frequencies to provide sound absorption over a broad band of frequencies. However, it will be appreiciated that the level of absorption over the band will not be as high as when a plurality of resonators is tuned to a particular frequency of interest. Permeable sound absorbing materials can be provided within all or a portion of the cells to increase the absorption, particularly at the higher frequencies. Some typical prior art devices employing the resonant cavity concept are disclosed in British Pat. Nos. 733,329 and 822,954 and U.S. Pat. Nos. Re. 22,283; 2,887,173; and 3,353,626. More recent and improved prior art geometrical sound absorbing structures based upon resonant cavities have been proposed by Leslie S. Wirt in U.S. Pat. Nos. 3,913,702; 3,831,710 and 3,734,234.

In geometrical sound absorbing structures of the resonator type wherein the resonators have uniform cross-sectional areas throughout their length, it has been determined that at frequencies for which the length of the resonator equals an odd multiple of quarter wavelengths, a resonance or near resonance occurs and good sound absorption is obtained. At frequencies for which the length of the resonator is an even number of quarter wavelengths, an anti-resonance occurs and poor sound absorption is obtained. The frequency at which such a resonator is tuned can be modified by modification in geometrical aspects of the resonator and/or the acoustical impedance of the admittance area to the resonator.

Upon detailed consideration of the prior art structures, it will be appreciated that one of the two distinct approaches has been employed in defining the admittance area for the sound wave into the resonator. One approach has included the use of a facing sheet for the resonator formed from an impermeable material but having minute perforations small in comparison to the other dimensional aspects of the resonator and the wavelengths of the frequencies to be absorbed. The other approach has included forming the resonators of a cellular structure having mutually perpendicular cross-sectional dimensional ratios of unity or near unity with each of the dimensions being relatively small in comparison to the wavelengths of the frequencies to be absorbed. Such constructions find their basis in the odd multiple quarter wavelength therory of resonance wherein the sound waves are received and propagated as plane waves longitudinally within the resonator.

It is the purpose of the present invention to provide a geometrical sound absorbing structure having good sound absorbing characteristics that does not require limitations included in the prior art devices previously described.

SUMMARY OF THE INVENTION

There is provided by the present invention a sound absorbing structure comprising a plurality of parallel impermeable wall means laterally spaced a distance not more than one wavelength of the highest frequency to be absorbed. The wall means defines therebetween an array of side-by-side elongate fluid filled cavities with adjacent open ends of the cavities providing the sound-receiving or admittance end for the sound waves into the cavities. The cavities have a dimension along the wall means greater than twice the spacing between the wall means. It will be apparent that this criteria, while permitting the presence of partitions between adjacent wall means, does not require their presence. As regards a cost effective product, it is preferred that partitions not be employed or only be employed as appropriate to provide structural integrity between the wall means. The elongate cavities have an uninterrupted length at least equal to one-fourth of the wavelength of the highest frequency to be absorbed. The cross section of the cavities is uniform substantially throughout the length thereof. The cavities are terminated at the ends thereof remote from their sound-receiving ends by an acoustically reflective, preferably impermeable, barrier.

In order to provide better absorption, it has been found advantageous to vary the lengths of the cavities. This also reduces the amount of materials necessary and, thus, the cost of manufacture. Permeable facing sheets of sound absorbing material or otherwise may be employed over the sound-receiving end of the array. Also, permeable sound absorbing material may be employed within the cavities.

BRIEF DESCRIPTION OF THE DRAWINGS

Some of the objectives of the invention having been stated, other objects will appear as the description proceeds, when taken in connection with the accompanying drawings, in which.

DESCRIPTION OF EMBODIMENTS

Figure 1:
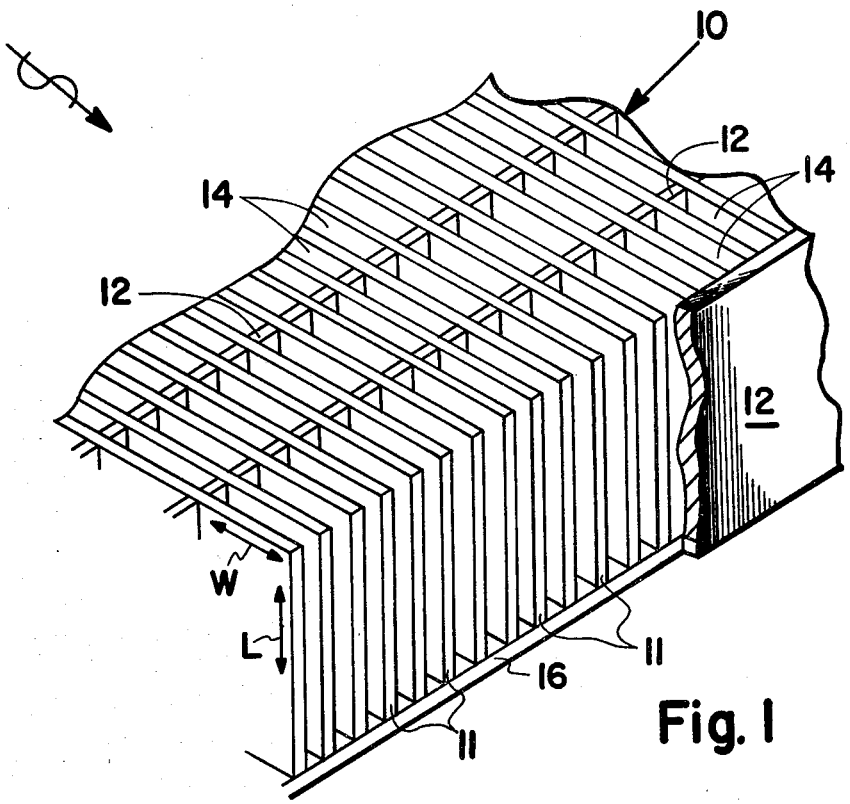
FIG. 1 is a perspective view, partially broken away, of a first embodiment of the present invention.

With reference to FIG. 1, there is shown in perspective a sound absorbing structure, generally designated at 10, of the present invention. The structure 10 comprises a plurality of parallel impermeable walls 11 laterally spaced a distance not more than one wavelength of the highest frequency to be absorbed. The walls 11 may be formed of any fluid impermeable material including but not limited to metal, plastic, plaster, wood, paper, fiber board or other suitable material. The material utilized need not, in and of itself, have sound absorbing capabilities. Spacings between the walls of from about $\frac{1}{4}$ inch to about $\frac{3}{8}$ inch are preferred. The walls are preferably as thin as structurally feasible for the material utilized.

In the structure 10, the walls 11 are planar and rectangular with their width W and length L extending in the directions indicated. The length L of the walls 11 is chosen to be at least equal to one-fourth of the wavelength of the highest frequency where good absorption is desired.

A particular feature of the present inention relates to the presence or absence of partitions 12 between adjacent walls 11. From a cost effective viewpoint, it is preferred that no partitions be provided between walls 11. However, in some instances partitions 12 are desired to provide structural integrity between the walls 11 and to close the sides of the array between walls 11. Also, moderate improvement in performance is obtainable by the presence of partitions. However, partition 12 spacing similar to that utilized in prior art devices is not necessary for good performance. In the structure 10, partitions 12 are shown at the open sides of the walls 11 and at intermediate positions between sides. If partitions 12 are utilized, they should also be impermeable and may be formed of the same materials as walls 11. The partitions 12 of structure 10 are planar and are othogonally disposed relative to walls 11. They need not be evenly spaced as shown. The spacing of partitions, between a pair of adjacent walls 11, should be substantially greater than the spacing between the adjacent walls 11 in order to obtain the economic advantages afforded by the present invention. Partition spacing greater than twice the spacing between adjacent walls 11 is appropriate. The spacing of partitions between a pair of adjacent walls 11 will be discussed further in conjunction with experimental data.

It will be apparent that the walls 11 in conjunction with the partitions 12, if utilized, define an array of side-by-side elongate fluid filled cavities 14 with adjacent open ends providing a sound-receiving or admittance end for sound waves. The sound-receiving end of the array of cavities 14 is planar and perpendicular to the walls 11. The cavities 14 are of uniform cross section throughout their length. The walls 11 and partitions 12 should have a length whereby the length of the cavities 14 is at least equal to one-fourth of the wavelength of the highest frequency where good absorption is desired. The cavities 14 are uninterrupted with sound absorbing material or other structure which will alter propagation of sound waves in the fluid filling the cavities.

The cavities 14 are terminated at the ends thereof remote from their sound-receiving end by an acoustically reflective, preferably impermeable, barrier 16. The barrier 16 may be formed of the same materials as walls 11 and partitions 12. In the embodiment of FIG. 1, the barrier 16 is planar and disposed perpendicular to the walls 11 and partitions 12 adjacent the ends thereof remote from the sound-receiving end of the array of cavities. The barrier 16 is common to each of the cavities 14 and is generally coextensive with the walls 11 and partitions 12. In this particular arrangement, each of the cavities 14 have a uniform length.

Experimental measurements of the random incidence absorption coefficients of structures of that of FIG. 1 as a function of spacing between partitions indicate that the sound absorption coefficient varies only about 20% at a given frequency. At mid-frequencies of about 1000 Hz, performance of such a structure is nearly insensitive to variations in partition spacing. It has also been noted that while peaks occur in the absorption coefficient at frequencies for which the cavity lengths are equal to odd multiples of quarter wavelengths, the peaks are not excessively predominate relative to other frequencies.

Figure 2:
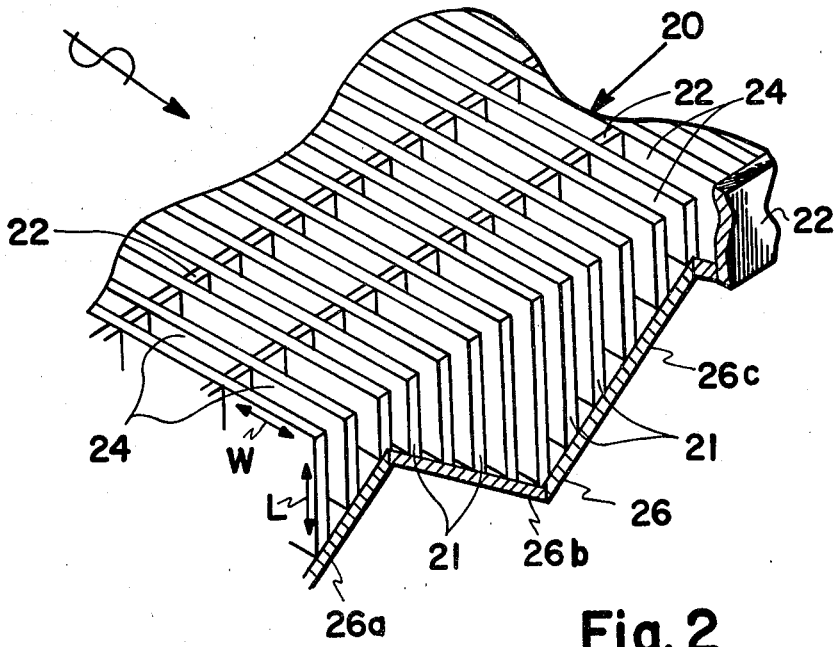
FIG. 2 is a perspective view, partially broken away, of a second embodiment of the present invention.

While the foregoing description illustrates the present invention, the sound absorption coefficient over a broad frequency range, such as the frequency range for speech intelligibility (normally considered to be from about 400 Hz to about 4000–5000 Hz), is high enough for many practical applications. However, for other applications, even higher sound absorption is desirable. It has been determined that performance of sound absorbing structure of the present invention can be significantly increased by varying the lengths of the cavities 14. There is illustrated in FIG. 2 such a sound absorbing structure 20. The structure 20 includes a plurality of parallel impermeable walls 21 laterally spaced a distance not more than one wavelength of the highest frequency to be absorbed. The walls 21 are planar and rectangular with their width W and length L extending in the directions indicated. Partitions 22 are shown at the open sides of walls 21 and at intermediate positions between adjacent walls 21. The walls 21 in conjunction with the partitions 22 define an array of side-by-side elongate fluid filled cavities 24 with adjacent open ends providing the sound-receiving end for sound waves. The sound recieving end is planar and perpendicular to the walls 21. The length L of the walls 21 varies between adjacent walls. The cavities 24 are of uniform cross section throughout their length L and are uninterrupted with materials that will alter propagation of sound waves via the fluid filling the cavities.

An impermeable barrier 26 is disposed adjacent the ends of the cavities 24 remote from their sound-receiving ends and terminate the cavities 24. The barrier 26 is secured to the walls 21 at an acute angle, preferably about 45°. In this way the length of the cavities 24 progressively varies along the barrier 26. In the present embodiment, the barrier 26 is considered to be divided into a plurality of sections including sections 26*a*, 26*b*, and 26*c*. Alternate sections converge and diverge toward and away from the sound-receiving ends of the cavities 24 to reproduce identical back-to-back regions of cavities. Within each region, the cavities 24 vary linearly from a relatively short length to a relatively long length. This variation in length results in tuning of adjacent cavities 24 for best absorption at different frequencies. The longer cavities are tuned to lower frequencies whereas the shorter cavities are tuned to higher frequencies. To some extent the sound absorption mechanism in structures of the present invention encompasses preferential absorption for cavities of length equal to odd multiples of a quarter wavelength of the frequency to be absorbed. Recognizing this feature will be helpful in determining the range of variations of length to select for the frequency of sound waves to be absorbed.

In FIGS. 3 through 6 there is schematically represented sound absorbing structures 30, 40, 50 and 60, respectively of the present invention. These structures have many features in common. Each of the structures 30, 40, 50 and 60 comprise a plurality of parallel impermeable walls 31, 41, 51 and 61, respectively, laterally spaced a distance not more than one, preferably not more than one-half, wavelength of the highest frequency to be absorbed. The walls are planar and rectangular with their length being represented in the respective Figures. No partitions are provided either at the open sides of the walls or between adjacent walls. The walls 31, 41, 51 and 61 in each instance define an array of side-by-side elongate fluid filled cavities 34, 44, 54 and 64, respectively, with adjacent ends providing the sound-receiving end for sound waves. The length of the walls progressively varies between adjacent walls. The cavities are of uniform cross section throughout their length and are uninterrupted with materials that will alter propagation of sound waves within the cavities via the fluid filling the cavities. In the structures 30, 40 and 50, the sound-receiving ends are planar and perpendicular to the walls.

Figure 3:
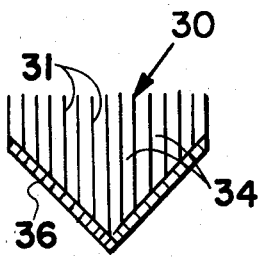
FIG. 3–6 are side elevational views, in section, of various other embodiments of the present invention.

With reference to FIG. 3, the structure 30 has an impermeable barrier 36 disposed adjacent the ends of the cavities 34 remote from their sound-receiving ends and terminates the cavities. As in structure 20, previously described, the barrier 36 is secured directly to the walls 31 at an acute angle, preferably about 45°. The barrier 36 is V-shaped.

Figure 4:
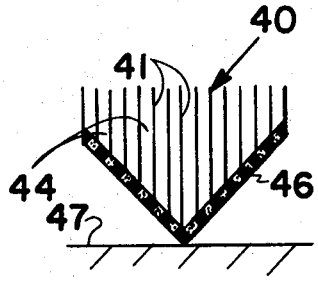
Figure 5:
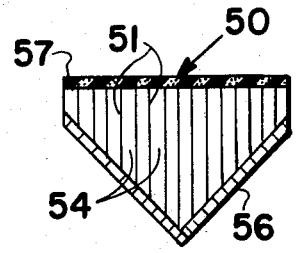

With reference to FIG. 4, the structure 40 has a sound absorbing, permeable urethane foam barrier 46 disposed adjacent the ends of the cavities 44 remote from their sound-receiving end and secured directly to the walls 41 at an acute angle, preferably about 45°. The layer 46 is V-shaped. A planar impermeable support 47 is disposed perpendicular to the walls 41 adjacent the barrier 46. adjacent the ends of the cavities 54 remote from their sound-receiving ends and terminates the cavities. The barrier 56 is secured directly to the walls 51 at an acute angle, preferably about 45°. The barrier 56 is V-shaped. In addition, the structure 50 is provided with a flexible, sound absorbing, permeable facing sheet 57 such as foam or the like.

Figure 6:
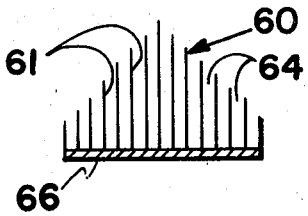

In structure 60 of FIG. 6, the sound-receiving end is disposed at an acute angle of about 45° relative to the walls 61. More specifically, the sound-receiving end has an inverted V-shape. It also has a planar impermeable barrier 66 disposed adjacent the ends of the cavities remote from their sound-receiving ends perpendicular to walls 61 and terminate the cavities 64.

As will be appreciated, in each of structures 30, 40, 50 and 60, the lengths of the cavities progressively vary in a linear fashion from a maximum length at the centers to a minimum length at opposite sides. The structures are symmetric about their centers. In appropriate instances, the cavities may be filled or partially filled with a permeable sound absorbing material.

Figure 10:
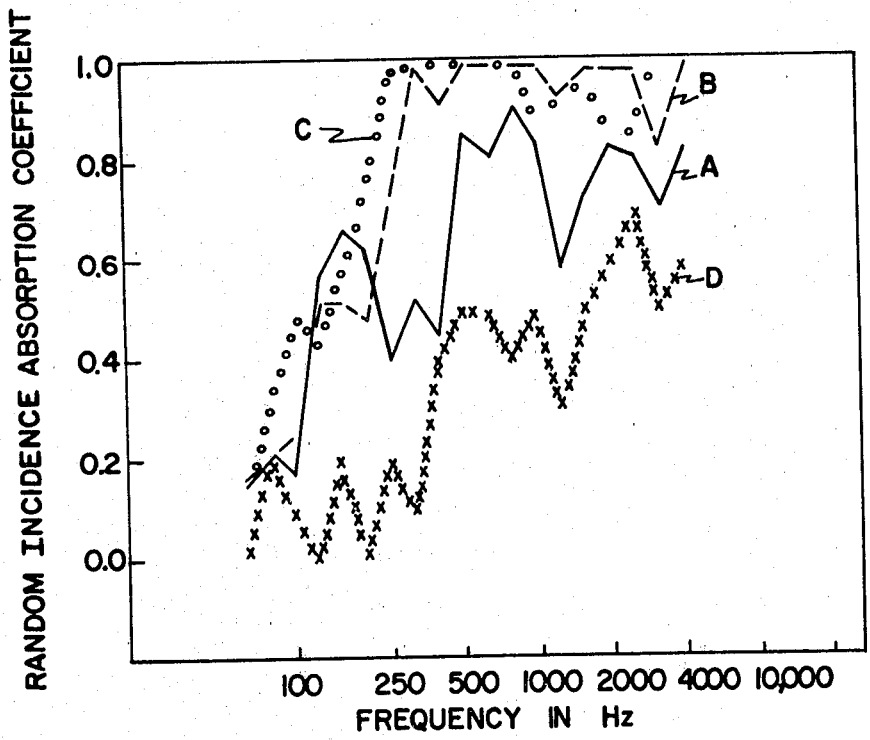
FIG. 10 diagrammatically illustrates the performance characteristics of the embodiments of FIGS. 3–6.

With reference to FIG. 10, there is graphically illustrated the sound absorbing characteristics of approximately 80 square feet of structures 30, 40, 50 and 60, respectively. In each case the walls were formed from 16 gauge steel sheet with a quarter inch spacing between walls and with the cavities having a maximum length of 6 inches. The barriers 36, 56 and 66 were formed from sheet steel. The barrier 46 was a one-half inch layer of urethane foam. The permeable facing sheet 57 was formed from one-half inch urethane foam.

Curve A represents the performance of structure 30. Curve B represents the performance of structure 40. Curve C represents the performance of structure 50. Curve D represents the performance of structure 60.

It will be appreciated that in each case good performance is obtained without the use of partitions between adjacent walls. Also, it is preferred to utilize a planar sound-receiving end that is perpendicular to the walls. Further, some improvement in performance is available through the use of either a permeable barrier or a permeable facing sheet.

Figure 7:
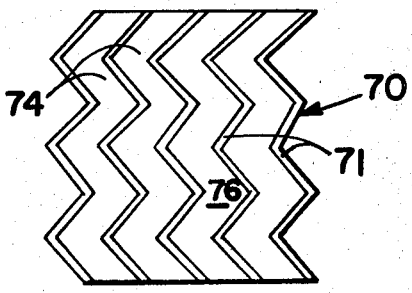
FIG. 7 is a top plan view of an embodiment of the present invention.
Figure 8:
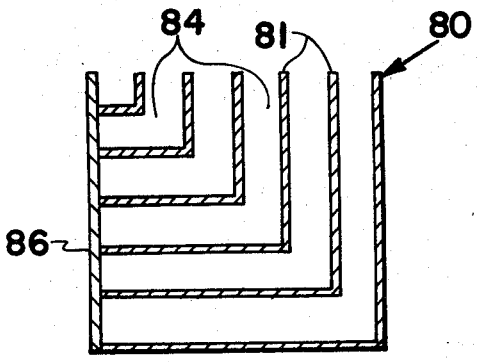
FIG. 8 is a side elevational view, in section, of an embodiment of the present invention.

FIGS. 7 and 8 illustrate structures 70 and 80, respectively, with reference characters for elements in the same sequence as the structures previously described in detail. Structures 70 and 80 have parallel walls other than planar. In FIG. 7, a top plan view, the structure 70 has parallel walls 71 which are zigzag along their width. In FIG. 8, a sectional side elevational view, the structure 80 has parallel walls 81 which are angularly disposed sections along their length such as sections disposed at right angles to each other. Various other parallel wall structures may be utilized in accordance with the present invention.

Figure 9:
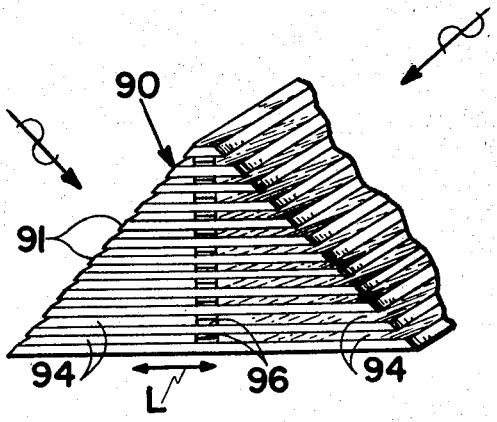
FIG. 9 is a partial perspective view of still another embodiment of the present invention.

FIG. 9 illustrates another and effective sound absorbing structure 90 of the present invention. The structure 90 comprises a plurality of elongate laterally spaced parallel and planar impermeable walls 91, the lengths (L) of which progressively vary in a linear fashion in the direction of their lateral spacing. Preferably as shown, the longitudinal centers of the walls 91 are aligned and symmetrically disposed about a central axis normal to the walls to define in longitudinal cross section a trapezoidal geometry. The walls 91 define an array of side-by-side elongate fluid filled cavities 94 with opposite ends of the cavities providing sound-receiving ends thereof. The cavities 94 are laterally spaced a distance not more than one wavelength of the highest frequency to be absorbed and have a dimension along the walls 91 perpendicular to thier lateral spacing coextensive with the walls 91. The length of the cavities 94 are at least equal to twice the quarter wavelength of the highest frequency where good absorption is desired. Impermeable barriers or spacers 96 are disposed within the cavities 94 midway between the opposed sound-receiving ends thereof for spacing the walls 91 and dividing the cavities into subcavities of nonuniform length.

In the drawings and specification, there has been set forth a preferred embodiment of the invention and, although specific terms are employed, they are used in a generic and descriptive sense only and not for purposes of limitation.

What is claimed is:

1. A structure for absorbing sound waves comprising a plurality of impermeable wall means that are (1) fabricated of a material generally impermeable to a fluid in which the sound absorbing structure is to be immersed, (2) substantially free of openings therethrough, (3) generally lacking in sound absorbing capability, (4) acoustically reflective, (5) laterally spaced a distance not more than one wavelength of the predetermined highest frequency to be absorbed, and (6) formed in a non-linear configuration along the length thereof, said wall means forming an array of side-by-side elongate fluid filled cavities each having an open end and a closed end, said open ends of said cavities receiving said sound waves each of said cavities (1) having an uninterrupted dimension along said wall means greater than twice the spacing between and coextensive with said wall means, (2) having a length from said open end to said closed end at least equal to one-fourth of the wavelength of the predetermined highest frequency to be absorbed, and (3) having a uniform cross section substantially throughout the length thereof, and acoustically reflective barrier means forming the closed ends of the said cavities, said barrier means reflecting said sound waves received within said cavities through said open ends in a direction opposite to the direction of propagation of said sound waves, the length of said cavities being uninterrupted between the sound-receiving end of said array and said barrier means.

2. A structure for absorbing sound waves comprising a plurality of impermeable parallel wall means that are (1) fabricated of a material which is generally impermeable to a fluid in which the sound absorbing structure is to be immersed, (2) substantially free of openings therethrough, (3) generally lacking in sound absorbing capability, (4) acoustically reflective, (5) laterally spaced a distance not more than one wavelength of a predetermined highest frequency to be absorbed, and (6) formed at an angle along the length thereof greater than 0° and less than 180°, said wall means forming an array of side-by-side elongate fluid filled cavities each having an open end and a closed end, said open ends of said cavities receiving said sound waves, each of said cavities (1) having an uninterrupted dimension along said wall means greater than twice the spacing between and coextensive with said wall means, (2) having a length from said open end to said closed end at least equal to one-fourth of the wavelength of the predetermined highest frequency to be absorbed, and (3) having a uniform cross section substantially throughout the length thereof, and acoustically reflective barrier means forming the closed ends of said cavities, said barrier means reflecting said sound waves received within said cavities through said open ends in a direction opposite to the direction of propagation of said sound waves, the length of said cavities being uninterrupted between the sound-receiving end of the array and said barrier means.

3. A structure for absorbing sound waves comprising a plurality of impermeable parallel wall means that are (1) fabricated of a material which is generally impermeable to a fluid in which the sound absorbing structure is to be immersed, (2) substantially free of openings therethrough, (3) generally lacking in sound absorbing capability, (4) acoustically reflective,and (5) laterally spaced a distance not more than one wavelength of a predetermined highest frequency to be absorbed, said wall means forming an array of side-by-side elongate fluid filled cavities each having an open end and a closed end with said wall means being formed in a non-linear configuration in the direction perpendicular to the length of said cavities, said open ends of said cavities receiving said sound waves, each of said cavities (1) having an uninterrupted dimension along said wall means greater than twice the spacing between and coextensive with said wall means, (2) having a length from said open end to said closed end at least equal to one-fourth of the wavelength of the predetermined highest frequency to be absorbed, and (3) having a uniform cross section substantially throughout the length thereof, and acoustically reflective barrier means forming the closed ends of said cavities said barrier means reflecting said sound waves received within said cavities through said open ends in a direction opposite to the direction of propagation of said sound waves, said cavities being uninterrupted between the sound-receiving end of the array and said barrier means.

4. A structure for absorbing sound waves comprising a plurality of impermeable parallel wall means that are (1) fabricated of a material which is generally impermeable to a fluid in which the sound absorbing structure is to be immersed, (2) substantially free of openings therethrough, (3) generally lacking in sound absorbing capability, (4) acoustically reflective, (5) laterally spaced a distance not more than one wavelength of a predetermined highest frequency to be absorbed, and (6) formed in a zigzag configuration along the length thereof, said wall means forming an array of side-by-side elongate fluid filled cavities each having an open end and a closed end, said open ends of said cavities receiving said sound waves, each of said cavities (1) having an uninterrupted dimension along said wall means greater than twice the spacing between said wall means, (2) having a length from said open end to said closed end at least equal to one-fourth of the wavelength of the predetermined highest frequency to be absorbed, and (3) having a uniform cross section substantially throughout the length thereof, and acoustically reflective barrier means forming the closed ends of said cavities said barrier means reflecting said sound waves received within said cavities through said open ends in a direction opposite to the direction of propagation of said sound waves, said cavities being uninterrupted between the sound-receiving end of said array and said barrier means.

5. A structure for absorbing sound waves comprising a plurality of impermeable parallel wall means that are (1) fabricated of a material which is generally impermeable to a fluid in which the sound absorbing structure is to be immersed, (2) substantially free of openings therethrough, (3) generally lacking in sound absorbing capability, (4) acoustically reflective, and (5) laterally spaced a distance not more than one wavelength of a predetermined highest frequency to be absorbed, said wall means forming an array of side-by-side elongate fluid filled cavities each having an open end and a closed end, said open ends of said cavities receiving said sound waves, each of said cavities (1) having an uninterrupted dimension along said wall means greater than twice the spacing between and coextensive with said wall means, (2) having a length from said open end to said closed end at least equal to one-fourth of the wavelength of the predetermined highest frequency to be absorbed, and (3) having a uniform cross section substantially throughout the length thereof;

acoustically reflective barrier means forming the closed ends of said cavities remote from the sound-receiving end thereof and terminating said cavities; and a sound absorbing, permeable facing sheet extending over and adjacent the sound-receiving end of said array of waveguide cavities, said cavities being uninterrupted from said facing sheet to said barrier means.

* * * * *